United States Patent [19]

Rösch et al.

[11] Patent Number: 4,892,069

[45] Date of Patent: Jan. 9, 1990

[54] THERMALLY STRESSED COMPONENT

[75] Inventors: Fritz Rösch, Schwabach; Bernd Otte, Zirndorf, both of Fed. Rep. of Germany

[73] Assignee: Alcan International Ltd., Montreal, Canada

[21] Appl. No.: 225,455

[22] Filed: Jul. 28, 1988

[30] Foreign Application Priority Data

Aug. 5, 1987 [DE] Fed. Rep. of Germany ..... 3726027

[51] Int. Cl.[4] ..... F02F 3/02

[52] U.S. Cl. ..... 123/193 CH; 123/193 P; 123/41.82

[58] Field of Search ..... 123/188 A, 188 AA, 213, 123/193 CH, 41.42, 193 P, 41.82

[56] References Cited

U.S. PATENT DOCUMENTS

| | | | |
|---|---|---|---|
| 3,233,599 | 2/1966 | Schober | 123/188 AA |
| 3,701,342 | 10/1972 | Owsley et al. | 123/188 AA |
| 3,730,163 | 5/1973 | Elsbett et al. | 123/213 |
| 4,332,221 | 6/1982 | Imhof et al. | 123/41.42 |
| 4,406,046 | 9/1983 | Adams et al. | 123/188 A |
| 4,524,732 | 6/1985 | Dworak | 123/193 CH |

*Primary Examiner*—E. Rollins Cross

*Attorney, Agent, or Firm*—Cooper & Dunham

[57] ABSTRACT

A component subjected to zonally differential thermal stress for engines, machinery or other devices, in particular a component for combustion engines. In these components, in order to arrange more favourably the stress variation as a function of temperature in the thermally highly stressed parts or regions, so that the adjoining colder regions do not reduce or hinder its expansion, in the material of the component, for example a piston of a combustion engine, in the neighbourhood of the zones of higher thermal loading, at least one closed hollow chamber is provided which is completely filled with a substance which has a higher coefficient of thermal expansion than that of the material of the component surrouding the chamber.

15 Claims, 4 Drawing Sheets

THERMALLY STRESSED COMPONENT

The invention relates to a component of engines, machines or other devices which is subject to zonally differential thermal stressing.

In thermally highly stressed and thus strongly heated parts or regions (so-called hot-spots) of internal components which are subject to differential heat stressing, such as for example piston surfaces of combustion engines, which come into direct contact with the hot combustion gases, differing thermal expansions locally occur as a result of temperature gradients. Thermal expansion of these regions is hindered by neighboring lateral or upper or lower lying colder regions. As a result, compressive stresses occur in the strongly heated parts or regions which lead to plastic deformation of the material of these regions or parts (hot-spots), which in turn result in tensile stresses in these regions upon subsequent cooling. These phenomena result from the fact that increasing temperature causes pressure build-up with elastic deformation of the material according to Hooke's law until at a particular temperature the elastic limit of the material is reached. With further temperature increase beyond its elastic limit, the material deforms plastically and begins to flow. Upon recooling, tensile stresses appear in the regions of the material which were previously deformed by the mentioned pressure build up and at low temperatures these tensile stresses in turn exceed the elastic limit of the material and can lead to plastic deformations therein. During the next and each subsequent temperature cycle, a continual alternation of compression and expansion takes place which eventually leads to crack formation.

Such phenomena appear for example in a combustion engine, in particular in the web (in the bridge) between the inlet and outlet valve of the cylinder head and on the periphery of the combustion chamber cavity of the piston.

In order to solve this problem, in combustion engines cooling channels have been provided in their thermally highly stressed parts or regions, which were supplied with oil, water or air as cooling medium (DE-AS- No. 15 76 733 and FR-PS No. 1 494 256). These cooling channels have an inlet and an outlet for the traversing cooling medium. Also, securely closed hollow chambers filled with cooling medium have been provided, the cooling medium only partially filling the hollow chambers (DE-PS No. 762 820, DE-AS No. 15 76 733 and DE-P No. 22 711 D). With these cooling channels or cooling chambers, the temperature in the critical zones can be reduced. A local temperature reduction however causes also an increase of the temperature gradients and thus also the stress gradients. Normally, the temperatures cannot be reduced to the extent that the crack formation caused by the above mentioned continual stress alternation can be completely prevented.

It has also been attempted to improve the properties of the material for thermally stressed components of combustion engines in their particularly highly stressed parts or regions, e.g. by coating these parts or regions with high temperature resistant metallic, ceramic or metal-ceramic materials which to some extent also are intended to be effective as heat insulation layers, or by the provision of ceramic or metallic cladding by welded inserts of strength enhanced elements or by embedding reinforcing fibres. It has however proved that the applied layers often have insufficient adhesiveness, that the ceramic inserts are subject to fracture as a result of their brittle material and that manufacturing problems exist in the embedding of reinforcing fibres.

For components which are subject to zonally differential thermal stressing and thus differential heating, the invention is therefore based on the object of more favorably adjusting the stress variation over the temperature range in thermally highly stressed parts or regions in such manner that the restriction of expansion caused by the adjoining colder regions is reduced or even eliminated. This is achieved according to the invention in that in the material of the component outside the zone of high thermal stressing but in the vicinity of this, at least one closed chamber is provided which is completely filled with a material which has a higher coefficient of thermal expansion than that of the surrounding material of the component. In this connection, the material completely filling the hollow chamber expediently has a substantially higher coefficient of thermal expansion than that of the material of the region or part of the machine containing the hollow chamber. Thus, a thermal expansion comparable to that of the more strongly heated zones or parts of the component is imparted to the less strongly heated zones or parts by the material of higher coefficient of thermal expansion provided therein, in order to prevent compressive and tensile stresses in the more strongly heated zones or regions, which could lead to crack formation. Thus, the invention lies in providing in these less strongly heated regions a thermal expansion which is as far as possible equal in magnitude to that of the neighboring more strongly heated regions of the component, in that bodies or materials having a higher coefficient of thermal expansion are provided in the regions which are less strongly heated.

In a preferred embodiment of the invention, the expansion material is a body which completely fills and is a form fit in the hollow chamber, the body having a solid state condition at the temperatures usually occurring in a combustion engine. It is however also possible to use as expansion material one which is solid at the usual environmental temperatures and only becomes liquid at higher temperatures, for example those which occur in the highly stressed parts or regions, during operation of the engine so that its enhanced expansion effect only appears above a predetermined temperature. In this connection, in particular use can be made of the increase in volume occurring in most materials upon change of state. Low-melting point metals may for example be employed as such expansion materials. Also however an expansion material which is liquid at normal environmental temperatures can be employed.

This expansion material, whether as a solid body or as a liquid, experiences, as a result of its essentially higher coefficient of thermal expansion at temperatures which lie below that of the highly thermally stressed parts or regions of the machine, an expansion of similar magnitude to that of these parts or regions. As a result, an expansion of the same magnitude as experienced by the hot-spot regions is imposed on these regions of the machine adjoining the hot-spot regions. As a result, this thermally highly stressed part or region of the machine experiences no or almost no restriction of its expansion so that even in the event of usual temperature alternations no or almost no cyclic compression and expansion of these parts or regions of the machine takes place.

If a liquid is employed as the expansion material, this liquid can be enclosed in a capsule or shell of metal or the like and be embedded at a suitable position with a form fit in the material of the machine part just as a solid body during casting of the thermally highly stressed machine part or with the aid of mechanical jointing methods. It is however also possible first to produce a hollow chamber in this machine part which later, for example, by means of a filler tube, is filled with the expansion material and closed.

The advantage of using a liquid expansion material consists in that the heat expansion coefficient of liquids is approximately one hundred times greater than the expansion coefficients of solids. Thus for example aluminium alloys which are usually used for the manufacture of the components of combustion engines, in particular the pistons, have linear coefficients of thermal expansion in the region of 21 to $24\times10^{-6}K^{-1}$, which corresponds to a coefficient of cubical expansion of approximately $65\times10^{-6}K^{-1}$. In contrast, the coefficient of cubical expansion of liquids lies in the region of $10^{-4}K^{-1}$. For example, for glycerin it is $5\times10^{-4}K^{-1}$, for benzol $12.3\times10^{-4}K^{-1}$, and for mercury $8.3\times10^{-4}K^{-1}$.

In the drawings, the realisation of the invention is represented on the one hand with a piston and on the other hand in a cylinder head of a combustion engine in various exemplary embodiments, which will be described in more detail in the following:

Figure 3:
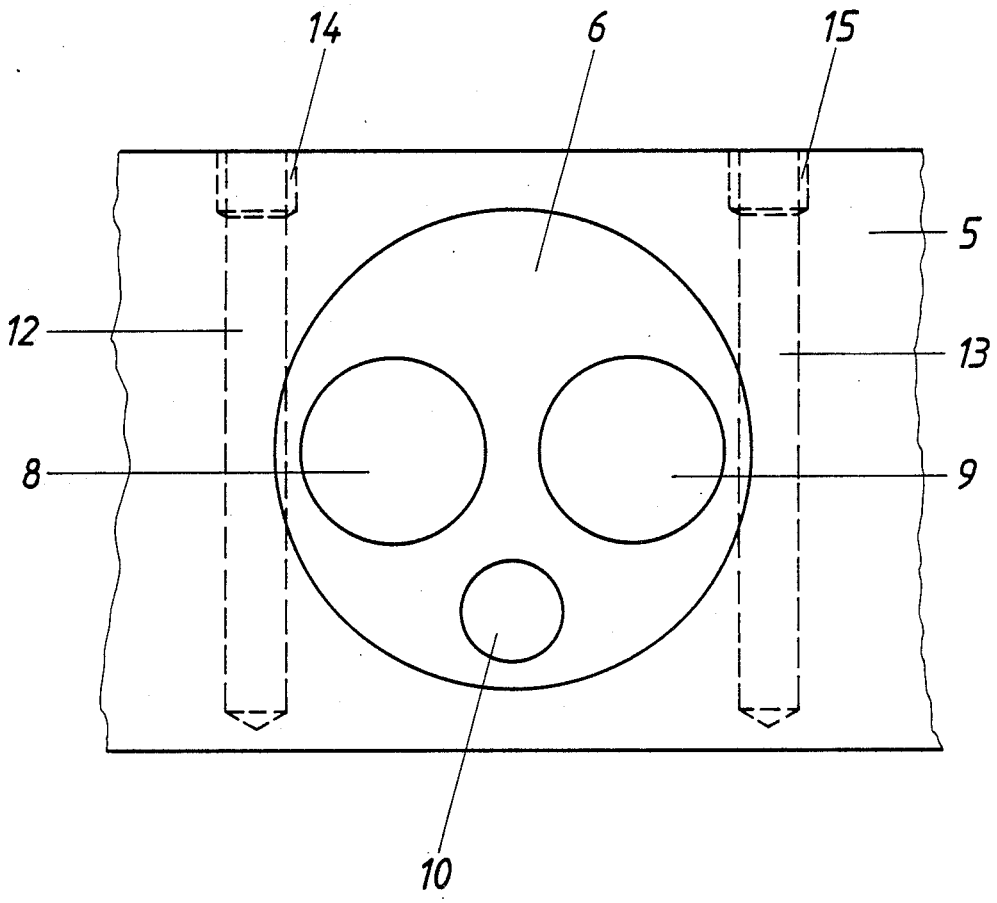
Figure 4:
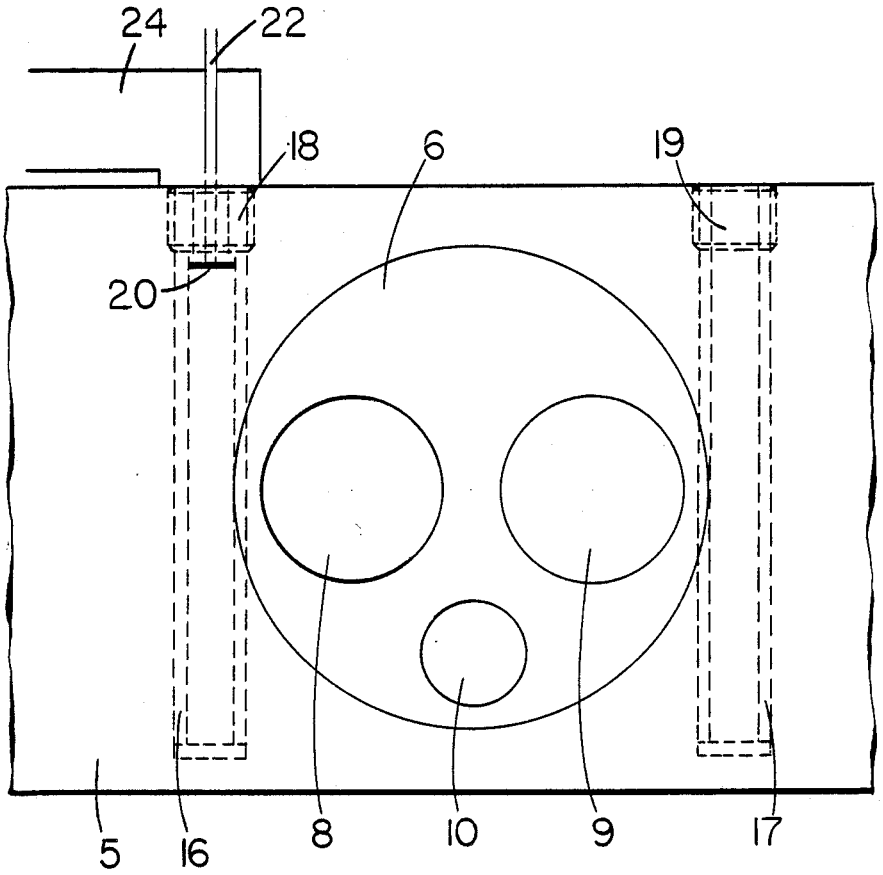

FIG. 3 likewise shows a part of the cylinder head of an internal combustion engine as seen from the combustion chamber in a second exemplary embodiment; and FIG. 4 likewise shows a part of the cylinder head of an internal combustion engine as seen from the combustion chamber in a third exemplary embodiment.

Figure 1:
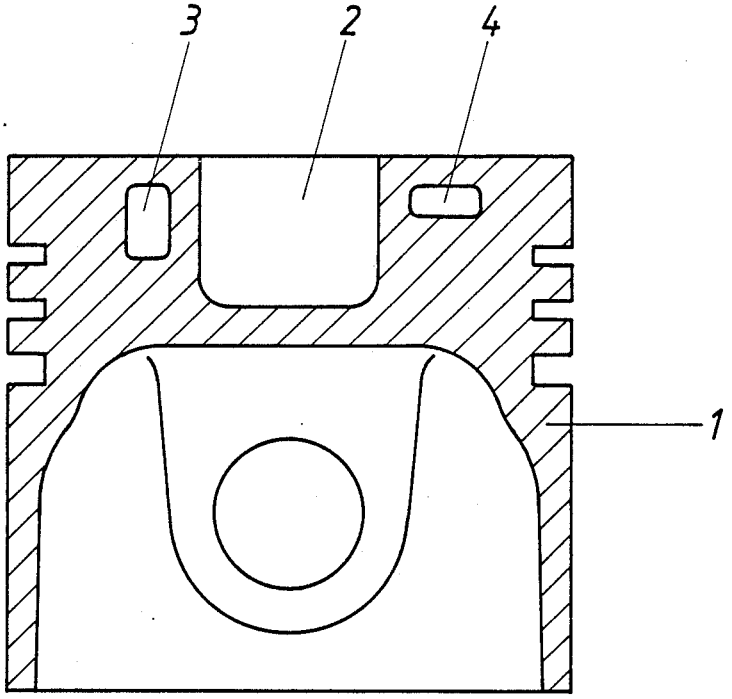
FIG. 1 shows an axial section through the piston of an internal combustion engine.

The piston 1 illustrated in FIG. 1 has a combustion chamber cavity 2 in its piston head. Behind the lateral edge of this combustion chamber cavity are provided closed chambers 3,4 which lie in the neighborhood of the combustion chamber cavity in the piston head material and which extend partially around the cavity and have differing cross-sectional shape. The configuration of these hollow chambers is so arranged that they lie directly in those regions of the piston head in whose vicinity a particularly high thermal stressing of the piston material takes place. It is however also possible to provide a single completely closed annular chamber around the entire combustion chamber cavity which can have uniform or changing cross-section. This chamber or these chambers are in the illustrated exemplary embodiment filled with a liquid substance as expansion material, which has a higher thermal coefficient of expansion than the material of the region of the piston head surrounding the hollow chamber, so that the liquid substance expands more strongly than the material of the piston head upon heating. Although the region of the piston head surrounding the hollow chambers 3,4 is not heated so strongly during engine operation as the edge of the combustion chamber cavity 2, in both regions expansions of approximately equal size are effective and the appearance of a stress gradient between these two regions is largely prevented.

Figure 2:
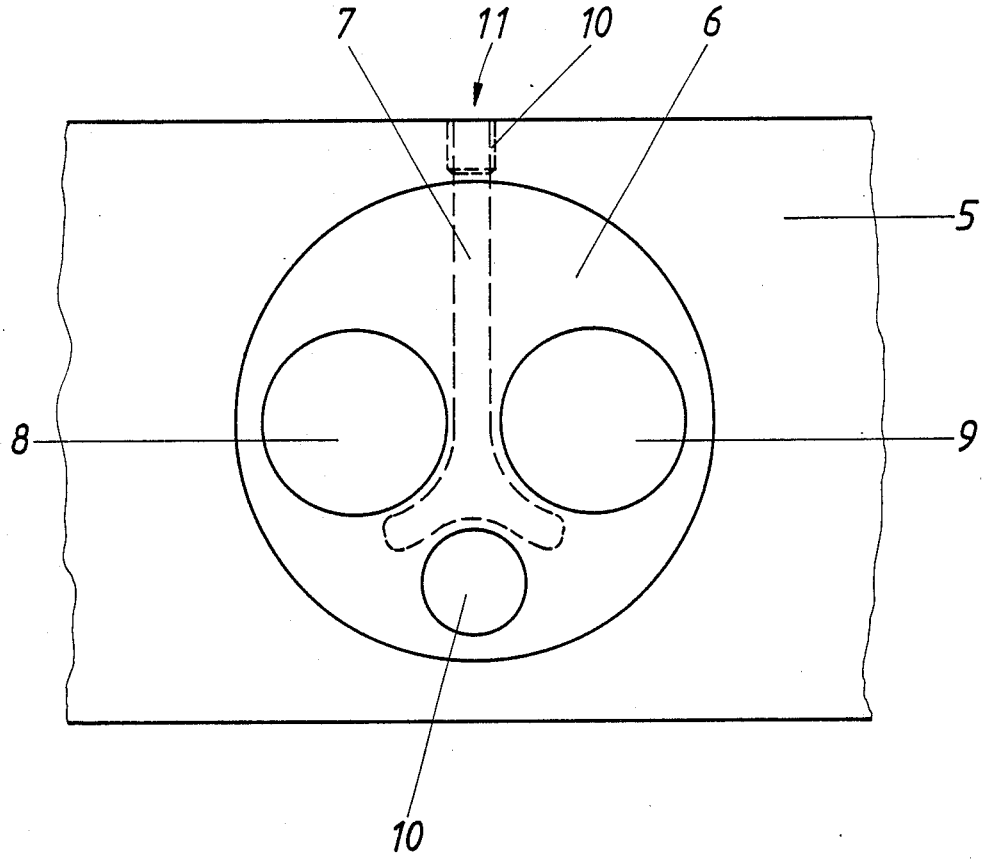
FIG. 2 shows a part of the cylinder head of an internal combustion engine viewed from the combustion chamber in a first exemplary embodiment.

In the exemplary embodiment of a cylinder head 7 illustrated in FIG. 2, beneath the surface 6 of the combustion chamber, an elongate hollow chamber 7 is provided which extends from the side of the cylinder head in the region between the inlet valve 8 and the outlet valve 9 and the front chamber inlet 10. This hollow chamber 7 emerges at the side of the cylinder head and is there provided with a connection 10 for connection to the engine oil supply of the internal combustion engine. The connection can be provided with a non-return valve which hinders reduction of the pressure increase desired in the hollow chamber 7 in the event of temperature stressing of the cylinder head over long periods. Any loss of oil in the hollow chamber 7 resulting from incomplete sealing or diffusion processes can be automatically equalised through the connection with the pressure oil reservoir of the engine via the non-return valve at low temperatures. The connection can also be provided with a pressure limiting valve.

It is however also possible in the exemplary embodiment illustrated in FIG. 2 after filling the hollow chamber 7 with expansion material in the region of the connection 10, to close the hollow chamber 7 securely and permanently.

In the exemplary embodiment illustrated in FIG. 3 of the cylinder head 5 with inlet and outlet valves 8,9 and a front chamber inlet 10 in its combustion chamber surface, in the cylinder head in the vicinity of the outlet sides of the inlet and outlet valves 8,9, elongate hollow chambers 12,13 are provided which open on one side of the cylinder head through connectors 14,15 for connection to the engine oil supply and/or for pressure limiting valves. These hollow chambers 12,13 lie approximately outside the thermally highly stressed zones of the cylinder head so that the expansion forces in the material of the cylinder head for stress relief act on the hot-spot region from a certain distance.

In the exemplary embodiment illustrated in FIG. 4 of the cylinder head 5 with combustion chamber surface 6 inlet and outlet valves 8, 9 and a front chamber inlet 10, expansion liquid is enclosed in capsules or shells 16, 17 which are inserted as a form fit without joints into the thermally stressed head 5 at least in its main expansion direction. The cylinder head 5 has a filling connector opening 18 connected to the shell 16 having the hollow chamber which receives expansion liquid, such as motor oil as previously described, via conduit 24, which in turn connects to the engine oil supply. The shell 16 is closed by valve 20 which has a valve rod 22. The other shell 17 is closed by solid body plug 19.

The closed hollow chambers filled with expansion material according to the invention can however also be employed in thermally highly stressed parts or regions of a combustion engine other than those indicated in the drawings. In this connection, these hollow chambers are expediently to be arranged in regions of the material of the engine or parts of the engine which directly adjoin thermally highly stressed parts or regions of the engine, in order to subject these parts or regions which are less thermally stressed upon temperature increase to an expansion which is approximately the same size as that of the highly stressed regions or parts of the engine.

The invention is however also applicable in other engines, machinery or device in which components are present which are subjected to zonally differential thermal stress. Thus, the hollow chambers according to the invention filled with expansion material can be applied inter alia also to other heat engines, to turbine blades, to machine components in reactor constructions and in chemical plants, to name only a few examples. The invention is also applicable to casting apparatus, forging equipment, and pressing tools in order in these shaping tools mostly manufactured of steel blocks, largely to prevent the danger of size and shape distortion given in particular as a result of the influence of stress gradients.

We claim:

1. Component for engines, machines or other devices subject to zonally differential thermal stress comprising at least one hollow chamber defined by the component outside and adjacent to zones of thermal stress which chamber is completely filled with a substance which has a higher coefficient of thermal expansion than material of the component surrounding the hollow chamber.

2. Component according to claim 1 wherein the hollow chamber is completely closed.

3. Component according to claim 1 wherein the substance having a higher coefficient of thermal expansion is a body which is a form fit in and completely fills the hollow chamber and which has solid state at least at normal environmental temperatures.

4. Component according to claim 3, wherein the substance with higher coefficient of thermal expansion is a material which is solid at normal environmental temperatures and which is liquid at the increased temperatures occurring in operation of the machine in its part or region containing the hollow chamber.

5. Component according to claim 1, wherein the substance with higher coefficient of thermal expansion has liquid state at normal environmental temperatures.

6. Component according to claim 5, wherein the expansion liquid is an organic substance such as for example oil, e.g. motor oil, glycerin, benzol, or an inorganic substance such as for example mercury.

7. Component according to claim 5, wherein the expansion liquid is enclosed in a capsule or shell which is inserted as a form fit and without joints into the thermally stressed part or region of the machine at least in its main expansion direction.

8. Component according to claim 5, wherein a filling connector opening from the machine component containing the hollow chamber is connected to the hollow chamber receiving the expansion liquid, and is closed by a valve.

9. Piston for an internal combustion engine as a component subjected to zonally differential thermal stress according to claim 1, wherein at least one hollow chamber filled with a substance of higher coefficient of thermal expansion is arranged in the piston head of the engine.

10. Piston according to claim 9, which has a combustion chamber cavity in its head, wherein at least one hollow chamber filled with a substance of higher coefficient of thermal expansion is provided in the vicinity of the edge of the combustion chamber cavity.

11. Cylinder head for an internal combustion engine as a component subjected to zonally differential thermal stress according to claim 1 wherein at least one hollow chamber filled with a substance having higher coefficient of thermal expansion is arranged in the cylinder head.

12. Cylinder head according to claim 11, wherein a hollow chamber filled with a substance having higher coefficient of thermal expansion is arranged in the region of the cylinder head lying between the inlet and outlet valve.

13. Cylinder head according to claim 11, wherein at least one hollow chamber filled with a substance having higher coefficient of thermal expansion is arranged in the region of the cylinder head of the engine lying between the inlet and outlet valves and the front chamber inlet.

14. Cylinder head according to claim 11, wherein hollow chambers filled with a substance with higher coefficient of thermal expansion are arranged in the regions of the cylinder head located on the outer sides of the inlet and outlet valves.

15. Component according to claim 5, wherein a filling connector opening from the machine component containing the hollow chamber is connected to the hollow chamber receiving the expansion liquid, and is closed by a solid body.

* * * * *